United States Patent [19]

Suessegger

[11] Patent Number: 5,005,770

[45] Date of Patent: Apr. 9, 1991

[54] SIFTER FOR SIFTING GRANULAR MATERIAL AND GRINDING SYSTEM HAVING INTRODUCTION THEREINTO OF SUCH A SIFTER

[75] Inventor: Albert Suessegger, Bergisch Gladbach, Fed. Rep. of Germany

[73] Assignee: Kloeckner-Humbolt-Deutz Aktiengesellschaft, Fed. Rep. of Germany

[21] Appl. No.: 482,236

[22] Filed: Feb. 22, 1990

[30] Foreign Application Priority Data

Feb. 20, 1989 [DE] Fed. Rep. of Germany ..... 3905123

[51] Int. Cl.[5] ..... B02C 21/00

[52] U.S. Cl. ..... 241/19; 241/24; 241/29; 241/79.1; 241/80; 241/152 A

[58] Field of Search ..... 209/144, 135, 134; 241/152 A, 29, 79.1, 19, 24, 80, 97

[56] References Cited

U.S. PATENT DOCUMENTS

| | | | |
|---|---|---|---|
| 4,211,641 | 7/1980 | Jager | 209/144 |
| 4,689,141 | 8/1987 | Folsberg | 241/79.1 X |
| 4,690,335 | 9/1987 | Allers et al. | 241/152 AX |
| 4,726,531 | 2/1988 | Strasser | 241/152 AX |
| 4,783,012 | 11/1988 | Blasczyk et al. | 241/29 X |

FOREIGN PATENT DOCUMENTS

| | | | |
|---|---|---|---|
| 84383 | 6/1986 | European Pat. Off. . | |
| 3711926 | 10/1988 | Fed. Rep. of Germany | 241/29 |
| 162022 | 4/1964 | U.S.S.R. | 209/144 |
| 1256817 | 9/1986 | U.S.S.R. | 209/144 |

*Primary Examiner*—Mark Rosenbaum

*Attorney, Agent, or Firm*—Hill, Van Santen, Steadman & Simpson

[57] ABSTRACT

A separator for separating fractions of granular material particularly for use in an interparticle crushing product bed comminution press including an outer conically shaped chamber with means for receiving air and the product to be comminuted at the lower end of the chamber, an inner conical chamber, a second coarse grits outlet leading from the inner conical chamber, a first coarse grits outlet leading from the outer conical chamber, a rotor at the upper end of the inner conical chamber having turbo elements thereon, baffles surrounding the turbo elements, and a fine products discharge from the upper end of the inner chamber with the coarse grits discharge from the outer chamber led back to the inlet of a high pressure interparticle crushing roller mill and the fine grits material discharged from the inner chamber led to a tubular mill.

7 Claims, 4 Drawing Sheets

SIFTER FOR SIFTING GRANULAR MATERIAL AND GRINDING SYSTEM HAVING INTRODUCTION THEREINTO OF SUCH A SIFTER

BACKGROUND OF THE INVENTION

The invention is related to a sifter for sifting granular material. The sifter comprises an entry for separating air and an entry for the material to be sifted, and also comprises a discharge for separating air and fine material. Also included is a coarse material discharge for the discharge of grits. The invention also relates to the grinding system in which such a sifter is to be incorporated. In the operation of high-pressure roller presses for compressing or for the pressure treatment of granular material, for example, of what is referred to as interparticle crushing of brittle material such as cement clinker. European Patent No. 0 084 383 discloses the charging stock supplied to the nip which stock must be seized by the oppositely driven rollers and drawn into the nip by friction. The individual particles of the grinding stock drawn into the nip by friction are thereby mutually crushed in a product bed, i.e., in a material fill that is compressed between the two roller surfaces with the application of extremely high pressure. The capability of the rollers to draw product in would be inherently improved if the charging stock were to be delivered in such a quantity that an abundance of charging stock is available in the charging shaft above the nip.

In the development of the art of pressing, such as pressing brittle granular material in the preparation of stock for cement making, a development was conceived which is known by the general terms of product bed comminution or interparticle crushing. In accordance with the concept, unique high pressure roller presses are arranged to apply a pressure in the nip wherein interparticle crushing occurs and the charging stock is drawn into the nip between opposed rollers and subjected to extremely high pressure such that the particles are subject to an interparticle crushing action causing incipient cracks in the particles so that they are subject to further refining or breaking up in mills such as a ball mill. This development is disclosed, for example, in U.S. Pat. No. 4,703,897, Beisner et al and U.S. Pat. No. 4,357,287, Schoenert. As used herein, the reference to interparticle crushing or product bed comminution is a reference to the art of pressing as disclosed in the foregoing patents.

It is also known to arrange such a high-pressure roller press for interparticle crushing of granular material ahead of a circulating grinding system comprising a tube mill and sifter to at least partially recirculate the grits of the sifter to the product delivery of the roller press. Particularly with high filling levels and low fill weights of the charging stock supplied to the charging shaft of the roller press and intensified by great quantities of already relatively fine grits that are recirculated to the roller press, the problem arises that the air pressed from the charging stock fill due to the high-pressure pressing can no longer escape. This is inhibiting to the material pressing and the energy saving that can be inherently achieved with interparticle crushing and leads to a non-uniform operation of the roller press. The aeration problem in the nip is further aggravated in that the fill density of the recirculated grits is usually considerably lower than the fill density of the fresh charging stock.

The object of the invention is to create a sifter that is suitable for being incorporated into a circulating grinding system that comprises a high-pressure roller press, a tube mill and a sifter in such a way that the energy-consuming aeration and material pressing difficulties in the nip of the roller press that are set forth above are considerably reduced. The invention, moreover, diminishes wear of the sifter, particularly when it is a turbo-air separator.

Characteristic of the sifter of the invention is that it comprises at least two grits discharge openings separated from one another, namely a discharge opening for coarse grits and a discharge opening for finer grits. For example, the grain size of the coarse grits can amount to more than 0.5 mm and the grain size of the finer grits can, for example, amount to less than 0.5 mm. When such a new sifter is inserted into a circulating grinding system comprising a high-pressure roller press and tube mill, then it becomes possible to recirculate the coarse grits of the sifter to the product delivery of the high-pressure roller press and recirculate the finer grits of the same sifter to the product delivery of the tube mill. The high-pressure roller press is thereby relieved of the fine material grits of the sifter, as a result of which the aeration and material pressing difficulties in the nip of the roller press are considerably diminished. The operation of the roller press becomes more uniform and the energy saving connected with interparticle crushing is not diminished by the above-described difficulties. The invention can also be fundamentally employed in a dynamic and static sifter.

The sifter of the invention is advantageously a dynamic sifter comprising a sifter housing in the lower region of which the entry opening for separating air and the discharge opening for the coarse grits are arranged and in which upper region a rotatably arranged rod basket having turbo elements is arranged that is surrounded by baffle elements arranged and distributed over the circumference thereof. It is precisely in such a turbo air separator that the wear at the sifter rotor, at the baffle elements and at the other inside sifter parts is diminished due to the pre-separation of the coarse grits. This is because the coarse grits in the sifter of the invention are withdrawn from the sifter, separately from the finer grits before they can come into contact with the sifter inserts.

The sifter of the invention is suitable for use with a circulating grinding system comprising a high-pressure roller press and comprising a fine comminution device such as a tube mill, being inserted thereinto in such a way that the sifter discharge for the coarse grits is returned to the product delivery of the roller press and the sifter discharge for the fine grits is returned to the product delivery of the tube mill. In this solution, both the high-pressure roller press having interparticle crushing and the tube mill operate under optimum conditions.

Other advantages, features and objects will become more apparent with the teaching of the principles of the invention in connection with the disclosure of the preferred embodiment thereof in the specification and drawings, in which:

DESCRIPTION OF THE PREFERRED EMBODIMENTS

Figure 1:
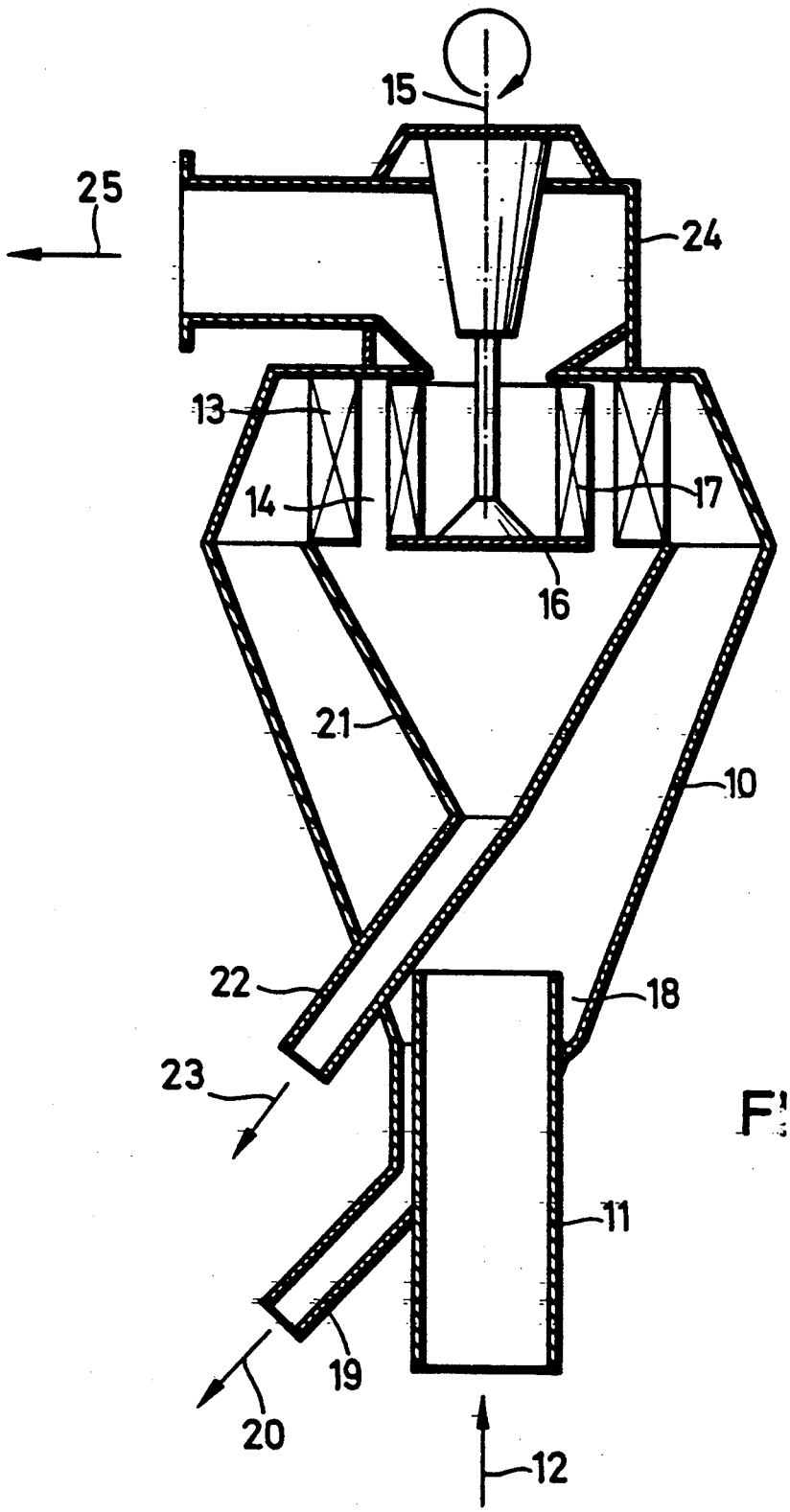
FIG. 1 is a vertical sectional view shown in schematic form a design of a separator embodying the principles of the present invention.

The sifter of FIG. 1 comprises a housing 10 that, as seen in a vertical section, tapers conically downward in its lower region and tapers conically upward in its upper region. A pipe 11 is introduced into the lower end of the sifter housing 10, and the separating airstream 12 charged with material to be sifted is introduced through pipe 11 into the sifter from below. The charged separating airstream flows through the sifter housing 10 from bottom to top. This separating airstream is reversed in the upper region of the sifter housing and flows through between leaf-shaped, potentially adjustable baffle elements 13 distributed over the circumference, and flows into the annularly shaped sifting zone 14 and into the sifter rotor or rod basket 16. The rod basket 16 is rotatably arranged in the sifter housing and driven from above by a shaft 15. This sifter rotor or rod basket carries leaf-shaped turbo elements 17 at its circumference and is terminated in a downward direction by a floor.

In its lower region, the sifter of FIG. 1 has a pre-separating zone for the coarse grits that also collect in the annular space 18 between the sifter housing and the pipe 11 projecting thereinto from below as a result of the cross-sectional expansion of the sifter housing 10. The coarse grits are discharged by the pipe 19 slanted obliquely in downward direction. The operating conditions of the sifter can thereby be set such that the grain size of the discharged, coarse grits 20 amounts, for example, to more than 0.5 mm. It will be readily understood that the inserts of the sifter are not reached by the pre-separated, coarse grits 20, as a result of which the overall wear of the sifter of the invention is alleviated.

After the coarse grits 20 have been withdrawn from the sifter, the finer grits remaining in the separating airstream fall down in the annularly shaped sifting space 14 and are captured by a cone 21 that downwardly adjoins to the underside of the baffle elements 13. The finer grits are withdrawn from the sifter separately from the coarse grits 20 by a pipe 22 slanted obliquely down, and are withdrawn as finer grits 23 having a grain size of, for example, less than 0.5 mm. The fine product is entrained by the separating airstream and is withdrawn from the sifter together therewith by a fine product discharge housing 24 that is non-corotating and is put in place above the rod basket 16, as indicated by the arrow 25.

Figure 2:
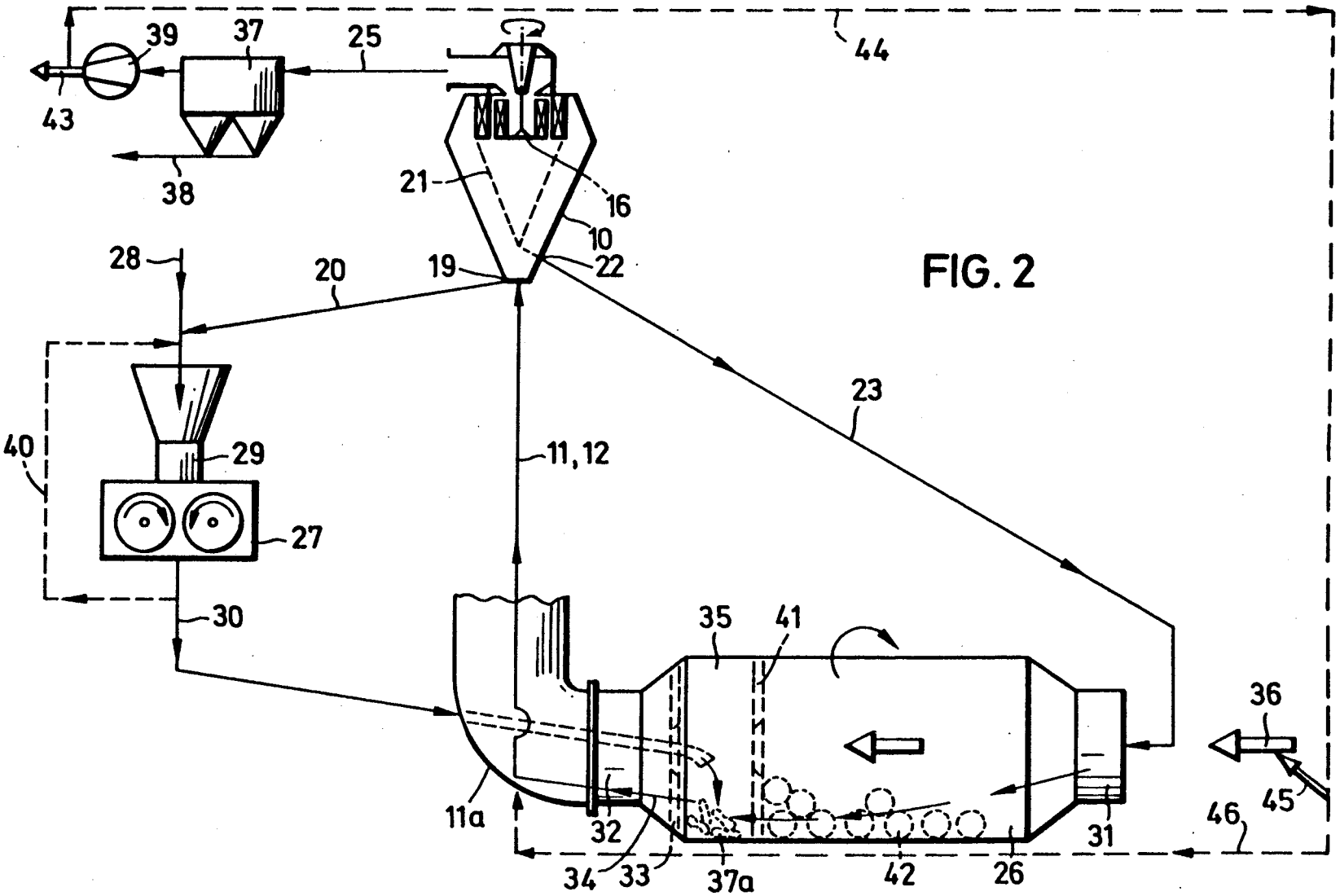
FIG. 2 is a side elevational view with portions in section shown in schematic form of a circulating grinding system embodying the sifter of FIG. 1.

According to FIG. 2, the sifter of FIG. 1 is introduced into a circulating grinding system comprising a tube mill 26 that is preceded by a high-pressure roller press 27, whereby the sifter discharge for the coarse grits 20 is returned to the product delivery of the roller press and the sifter discharge for the finer grits 23 is returned to the product delivery of the tube mill 26. The high-pressure roller press 27 is supplied with the charging stock 28 to be comminuted, i.e., non-precomminuted cement clinker having a grain size of, for example, up to 100 mm, being supplied therewith via a charging shaft 29. The grain size of a substantial part of the charging stock 28 is greater than the width of the narrowest nip of, for example, 20 mm between the two pressing rollers that, for example, can have a diameter of 900 mm. The pressing power of the rollers of the roller press pressing on the materials 28 and 20 amounts to more than 2 t per centimeter of roller length, for example 6 through 9 t/cm. The charging stock is comminuted in the nip between the rollers due to a combined individual grain crushing and interparticle crushing. For the implementation of this latter comminution principle, the charging stock to be comminuted is supplied to the nip of the press 27 in such a great quantity by the charging shaft 29 arranged above the nip so that the material to be comminuted and drawn in between the rollers by friction presses the rollers apart and the particles of the charging stock crush one another in the nip in a fill, a collective or in a product bed. The cement clinker emerges from the nip comminuted and partially agglomerated, i.e., pressed into scabs 30 whose proportion of particles already reduced to the desired cement fineness can be relatively high (above 25% smaller than 90 μm). Whereas the fill density of the fresh grinding stock 28 amounts to 1,600 kg/m$^3$, the density of the pressed scab 30 amounts to on the order of 2,400 kg/m$^3$.

In that only the coarse grits 20 of the sifter 10 are recirculated into the delivery shaft 29 of the roller press 27 but not the finer grits 23, the material pressing and aeration in the interparticle crushing is not impeded in the region of the narrowest nip of the roller press. Quite to the contrary, the mixing of only the coarse grits 20 to the fresh charging stock 28 can even improve the draw-in conditions for the entire charging stock in the nip of the roller press 27 with interparticle crushing.

The tube mill 26 of FIG. 2 is an airstream mill having a central product input opening 31 through the one front wall neck and a central discharge opening 32 through the other front wall neck. The tube mill comprises a discharge wall 33 in front of its discharge opening 32, the openings of this discharge wall 33 only admitting pre-ground material having a defined grain size to pass, as illustrated by the arrow 34. The discharge 30 of the roller press 27 is introduced into the product discharge of the tube mill 26 by a scab pre-comminution means, not shown.

The discharge 30 proceeds through the central mill discharge opening 32 and through the central opening of the discharge wall 33, in counter-current flow relative to the tube mill discharged product that, together with the roller press discharge which is deagglomerated in the deagglomeration chamber 35, is pneumatically conveyed to the sifter 10. This is with the assistance of a conveying airstream 36 and is conveyed through peripheral openings of the same discharge wall 33 as a product stream 34 by the ascending line 11 whose lower part 11*a* joins to the central product discharge opening 32 of the tube mill. The discharged material 30 (scab fragments) coming into the deagglomeration chamber 35 of the tube mill 26 is referenced 37*a*. These scab fragments 37*a* are autogenously disintegrated by exclusive circulatory motion.

The sifter 10 sifts the adequately fine finished product from both the deagglomerated discharged product 30 from the roller press as well as from the ground product of the tube mill 26, namely as a fine grain fraction. The fraction is withdrawn by the conduit 25 and dust separator 37, for example an electrostatic dust separator, from which the fine finished product 38, i.e., the adequately finely ground cement in the exemplary embodiment is withdrawn. 39 indicates an induced draft blower. There is also the possibility of recirculating a sub-stream of the discharged product 30 from the roller press into the delivery shaft 29 of the roller press 27 by the connection 40 indicated with broken lines.

An existing tube mill can be utilized for realizing the circulating grinding system of FIG. 2 upon utilization of the sifter of the invention without the necessity of remodeling. As a single remodeling or augmentation measure, a perforated partition 41 that separates the actual grinding chamber containing the grinding members 42 from the deagglomeration chamber 35 placed between the discharge wall 33 and partition 41 can be integrated into the tube mill 26 at a distance from the discharge wall 33 that is already present, insofar as the existing tube mill was not originally a two-chamber mill with partition. The tube mill can also comprise a product outflow housing having a bucket elevator for conveying the grinding stock to the sifter.

When the airstream 36 is a hot gas stream, then the circulating grinding system of FIG. 2 can be employed as a grinding-drying system for grinding and drying moist material, for example, damp initial material for producing raw cement meal. The ascending line 11 between the mill 26 and sifter 10 then serves as a flow dryer. There is the possibility of branching off a sub-stream 44 from the drying gas stream 43 following the induced draft blower 39 and of mixing this to the fresh hot gas stream 36 through the conduit 45 and/or introducing this at the bottom into the flow dryer 11 through the conduit 46. Some other fine-comminution means could also be used instead of the tube mill 26.

Figure 3:
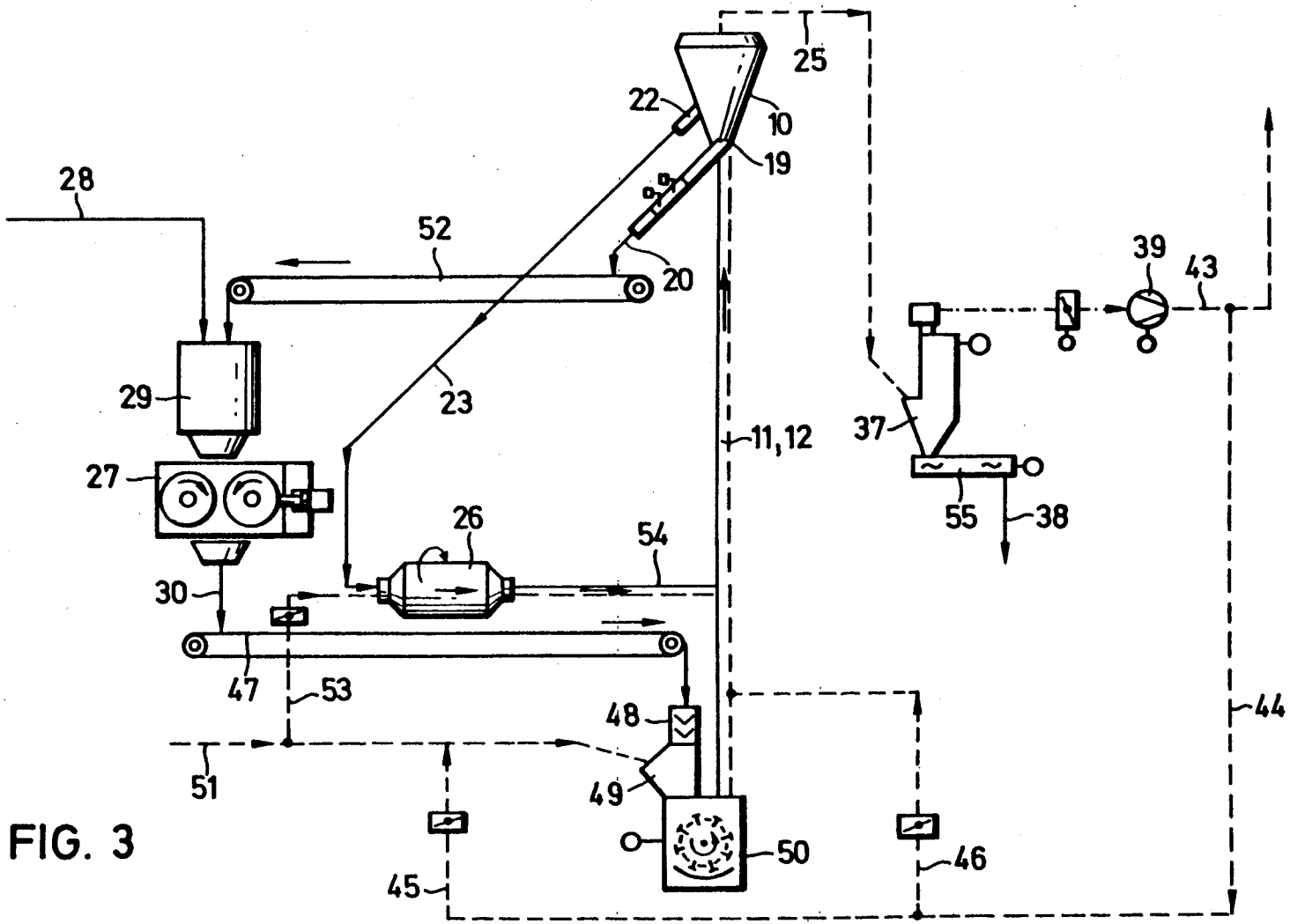
FIG. 3 is another schematic illustration illustrating a further embodiment of the invention.

FIG. 3 shows the flow chart of a grinding-drying system for grinding and drying damp initial material for the manufacture of raw cement meal. The initial material 28 is delivered by the delivery shaft 29 of the high-pressure roller press 27 and is comminuted there as shown in FIG. 2. The scabs 30 being formed are introduced by a conveyor means 47 as well as by a material sluice 48 into the product entry 49 of an impact hammer mill 50 with closed floor, and is deagglomerated there. A hot gas conduit 51 indicated with broken lines is connected to the product entry 49 of the deagglomerator 50. Exhaust gas of a pre-heater for raw cement meal of a cement clinker burning system, hot exhaust air of a cement clinker cooler or/and hot gas of some other hot gas generator can be employed as hot gas. The ascending line 11, 12 shown as a flow dryer is connected to the product discharge of the deagglomerator 50, the product being dried in this ascending line which leads to the sifter 10, and the sifter discharge 19 for the coarse grits 20 is conducted by a conveyor 52 to the product delivery 29 of the roller press 27, and the sifter discharge 22 for the finer grits 23 is conducted to the product delivery of a tube mill 26.

The finer grits 23 are introduced into the tube mill 26 together with a hot gas stream 53 that can be branched off from the hot gas conduit 51, such as from hot flue gas or hot exhaust gas of a cement clinker burning system and which thus has the property of an inert gas. This is of significance when the damp charging stock 28 to be treated in the grinding-drying system of FIG. 3 is not damp raw materials for cement but which may be, for example damp coal. After the treatment in the tube mill 26, the material is introduced by conduit 54 into the ascending line 11, 12 leading to the sifter 10. The fine product discharge line 25 of the sifter 10 leads to the separator 37 such as a filter, separating cyclone or the like. This separating cyclone separates the fine material from the separating gas stream or, from the drying gas stream 43 as finished product 38, for example as completely dried and ground raw cement meal or, as completely dried and ground coal by a conveyor 55 such as a worm conveyor. Following the separation of the finished product, the exhaust gas conduit 43 is in communication through the branch conduit 44, 45 with the hot gas conduit 51 connected to the product entry 49 of the deagglomerator 50 and/or is in communication through a branch conduit 46 with the ascending line 11, 12 connected to the product discharge of the deagglomerator 50.

Figure 4:
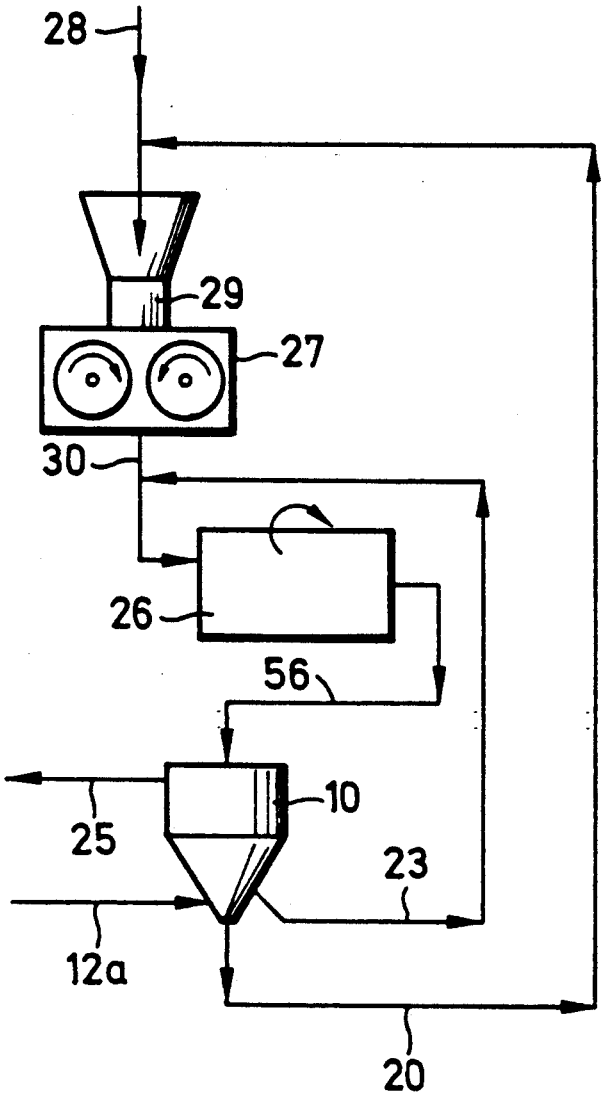
FIG. 4 is a schematic showing of a portion of a grinding system illustrating a further embodiment of the invention.

Whereas FIGS. 1 through 3 show a sifter to which the charging stock is supplied together with the separating air, FIG. 4 shows a sifter 10 to which the charging stock is supplied separately from the separating air. The sifter 10 is introduced into a circulating grinding system comprising a tube mill 26 and high-pressure roller press 27. In this circulating grinding system, too, the discharge line 20 of the sifter 10 for the coarse grits is recirculated to the product delivery of the high-pressure roller press 27 and the discharge line 23 for the finer grits is recirculated to the product entry of the tube mill 26. The mill 26 can be operated in open throughput. The material discharged from the mill is delivered by conduit 56 onto a distributing plate rotating inside the sifter 10. **12*a* references the entry of the separating air into the sifter and 25 references the withdrawal of the separating airstream loaded with the fine material from the sifter 10. The advantages of the invention, obtained in the structure of FIGS. 1, 2 and 3, are also obtained with the embodiment of FIG. 4**.

I claim as my invention:

1. A circulating grinding system for grinding particulate material comprising in combination:

a high pressure roller press having an entry nip for interparticle crushing delivering partially agglomerated scabs which include finely ground material;

a tube mill having an input connected to receive the output from said roller press and grinding the material breaking the agglomerate;

a separator connected to receive an output from the tube mill, said separator having a coarse grit fraction output and a fine grit fraction output;

first conduit means connected said coarse grit fraction output directly to the nip of said roller press whereby the coarse grits are passed through the roller press with other stock; and second conduit means connected said fine grit fraction to the input of the tube mill whereby the separated fine grit fraction is mixed with input to the tube mill from the roller press.

2. A circulating grinding system for grinding particulate material constructed in accordance with claim 1:

wherein said separator is a cyclone having a separation chamber with an inlet means for delivering air to the chamber.

3. A circulating grinding system for grinding particulate material constructed in accordance with claim 2:

wherein said chamber contains a rotatable bar basket having circumferentially spaced turbo-elements carried thereon;

a stator baffle element circumferentially surrounding the bar basket;

a downwardly slanting surface leading from the stator baffle elements to a finer grits discharge opening; and a finer product opening being above the bar basket.

4. A circulating grinding system for grinding particulate material constructed in accordance with claim 1:

wherein said tube mill has a perforated partition therein separating the mill into a first grinding chamber containing grinding members and a second deglomeration chamber having an absence of grinding members.

5. A circulating grinding system for grinding particulate material constructed in accordance with claim 1:

wherein said separator contains a cyclone chamber;

a rotary power driven turbo-element within the cyclone chamber;

stationary elements surrounding the turbo-chamber;

an outer conically shaped chamber for the coarse grit fraction;

a coaxial inner conical chamber for the fine grit fraction; and a lower tubular conduit for the entrance of air leading to the outer conical chamber.

6. The method of grinding particulate material in accordance with the steps:

grinding a supply of particulate material with a high pressure roller press forming interparticle crushing and providing partially agglomerated scabs which include finely ground material;

delivering the output of the high pressure roller press to a tube mill and grinding the material breaking the agglomerates in the tube mill;

separating the material from the output of the tube mill into a coarse grit fraction and a fine grit fraction;

delivering the coarse grit fraction to the input of the roller press to mix with the stock material delivered thereto;

delivering the fine grit fraction material from the separator to the tube mill to be ground with the output from the high pressure roller press.

7. A method for grinding particulate material in accordance with the steps of claim 6, including separating the output from the tube mill with a cyclone separator.

* * * * *